US005617615A

United States Patent [19]

Hösel

[11] Patent Number: 5,617,615

[45] Date of Patent: Apr. 8, 1997

[54] METHOD AND APPARATUS FOR DEPOSITING SLIVER IN A COILER CAN

[75] Inventor: Fritz Hösel, Mönchengladbach, Germany

[73] Assignee: Trüzschler GmbH & Co. KG, Mönchengladbach, Germany

[21] Appl. No.: 458,470

[22] Filed: Jun. 2, 1995

[30] Foreign Application Priority Data

Aug. 11, 1994 [DE] Germany ..... 44 28 475.6

[51] Int. Cl.[6] ..... B65H 54/80

[52] U.S. Cl. ..... 19/159 R

[58] Field of Search ..... 19/159 R, 159 A

[56] References Cited

U.S. PATENT DOCUMENTS

| | | | |
|---|---|---|---|
| 5,172,453 | 12/1992 | Akiyama | 19/159 R |
| 5,428,869 | 7/1995 | Holubec et al. | 19/159 R |

FOREIGN PATENT DOCUMENTS

| | | | |
|---|---|---|---|
| 1471923 | 3/1966 | France | 19/159 A |
| 2802216 | 7/1979 | Germany | 19/159 R |
| 0017864 | 2/1981 | Japan | 19/159 R |
| 1164917 | 9/1969 | United Kingdom . | |
| 2019905 | 11/1979 | United Kingdom . | |
| 2216909 | 10/1989 | United Kingdom | 19/159 R |

*Primary Examiner*—Ismael Izaguirre
*Attorney, Agent, or Firm*—Spencer & Frank

[57] ABSTRACT

An apparatus for depositing sliver in a coiler can includes a pair of cooperating pressure rolls; a coiler head rotating about a rotary axis and having a sliver inlet for receiving sliver from the rolls and a sliver outlet situated eccentrically with respect to the rotary axis for discharging sliver from the coiler head; a movable coiler can platform disposed underneath the coiler head for receiving an upwardly open coiler can thereon; and a severing device for severing the sliver at a location downstream of the rolls as viewed in a direction of sliver run. The position of the sliver outlet on its circular path, the position of the platform in its motion path and the running length of sliver are determined. Based on these data rotation of the coiler head is stopped when the sliver outlet is in a position corresponding to a predetermined total sliver quantity in the coiler can less a trailing terminal sliver length portion, the platform is moved in a stopped state of the coiler head such that the coiler can outline is out of vertical alignment with the coiler head, whereby a trailing length portion is deposited in the coiler can and a part of the trailing length portion hangs over a top wall edge of the coiler can.

9 Claims, 5 Drawing Sheets

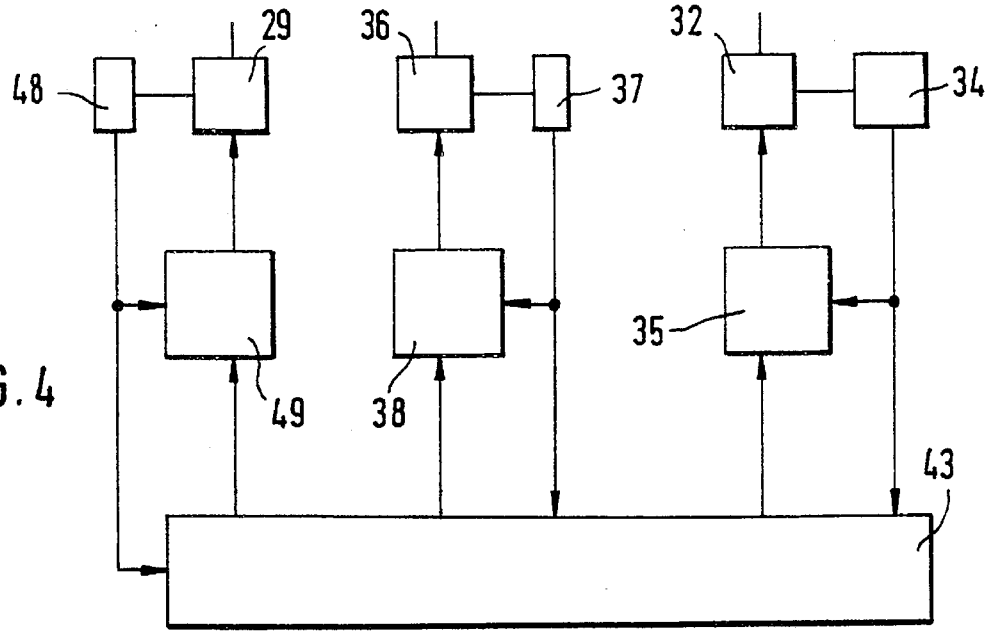
FIG. 4
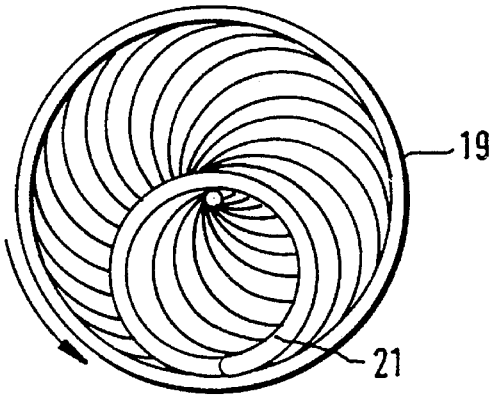
FIG. 5
FIG. 6
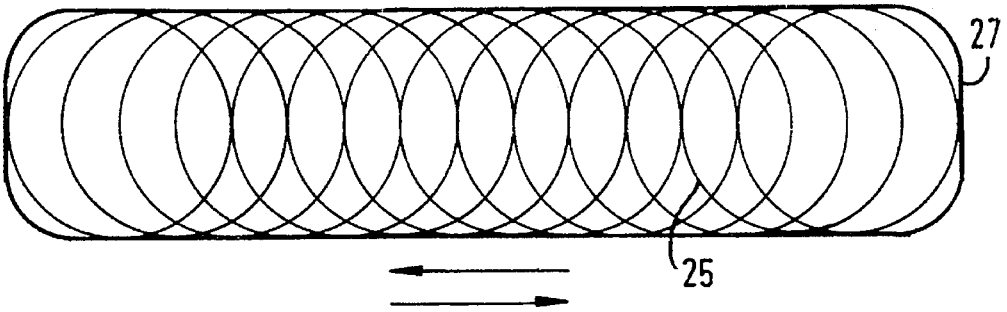

METHOD AND APPARATUS FOR DEPOSITING SLIVER IN A COILER CAN

CROSS-REFERENCE TO RELATED APPLICATION

This application claims the priority of German Application No. P 44 28 475.6 filed Aug. 11, 1994 which is incorporated herein by reference.

BACKGROUND OF THE INVENTION

This invention relates to a method and apparatus for depositing textile sliver into a coiler can, particularly a can with an elongated horizontal cross-sectional outline, referred to as a flat coiler can. The sliver is the product of a carding machine or a drawing frame and is advanced thereby to pressure rolls which, in turn, forward the sliver into a rotary coiler head which deposits the sliver into the reciprocated flat coiler can in an annular pattern. When the can is filled, it is moved away from the coiler head such that the can outline will be situated laterally beyond the coiler head and the sliver is severed to thus obtain a sliver end of the sliver contained in the coiler can.

In a known process, as disclosed in EP Patent Document 0 457 099, a can is filled with sliver. In the zone of the emplacement for the filled coiler cans a sliver severing device is provided. The severing device may be formed of a pivotal clamping bar which cooperates with the gripper grasping that coiler can which is pushed out from under the coiler head and which is closest to the coiler head. By virtue of this arrangement, upon firmly clamping the sliver connecting the two coiler cans, a sliver severing occurs when the coiler can situated in the filling position moves away from the filled and pushed-out coiler can during the sliver filling process. In this manner the sliver is pulled apart and severed at a predetermined clamping location. Upon releasing the gripper from the filled coiler can and upon subsequent positioning of the can, for example, onto a can transporting (removal) device, the sliver end will assume a position in a predetermined region underneath the coiler can edge and in the region of one of the narrow sides of the flat coiler can. It is a condition for achieving such a result that the coiler can exchange occurs at a moment in which the region of that narrow side of the coiler can is underneath the coiler head which is closest to the empty coiler can to be exchanged for the full coiler can. Upon deposition of the last sliver layer, the coiler can remains in the same position underneath the coiler head. It is a disadvantage of this arrangement that the sliver quantities deposited in the can are changing from can to can. The sliver charging depends, among others, from the location of filling and deviations which may result from the back and forth travel of the coiler can during sliver filling. The length of the severed, linear sliver which hangs across the top edge of a transverse wall of the coiler can is approximately of constant length. The total sliver quantity, that is, the can fill of annular pattern and the overhanging linear sliver length is, however, different in case of different coiler cans.

SUMMARY OF THE INVENTION

It is an object of the invention to provide an improved method and apparatus of the above outlined type, from which the discussed disadvantages are eliminated and which, in particular, makes possible the positioning of the sliver end at a predetermined location of the coiler can and ensures the deposition of an accurately predetermined total sliver quantity.

This object and others to become apparent as the specification progresses, are accomplished by the invention, according to which, briefly stated, the apparatus for depositing sliver in a coiler can includes a pair of cooperating pressure rolls; a coiler head rotating about a rotary axis and having a sliver inlet for receiving sliver from the rolls and a sliver outlet situated eccentrically with respect to the rotary axis for discharging sliver from the coiler head; a movable coiler can platform disposed underneath the coiler head for receiving an upwardly open coiler can thereon; and a severing device for severing the sliver at a location downstream of the rolls as viewed in a direction of sliver run. The position of the sliver outlet on its circular path, the position of the platform in its motion path and the running length of sliver are determined. Based on these data rotation of the coiler head is stopped when the sliver outlet is in a position corresponding to a predetermined total sliver quantity in the coiler can less a trailing terminal sliver length portion, the platform is moved in a stopped state of the coiler head such that the coiler can outline is out of vertical alignment with the coiler head, whereby a trailing length portion is deposited in the coiler can and a part of the trailing length portion hangs over a top wall edge of the coiler can.

According to the invention, the deposition of the sliver is discontinued — by stopping the rotary motion of the coiler head — at such a location which ensures a sliver production of an accurately predetermined total sliver quantity to the sliver end. After the rotary motion of the coiler head is arrested at a predetermined position of its sliver outlet, the pressure rolls continue to deliver fiber material and, at the same time, the coiler can continues to move in one direction. The sliver from the last deposited sliver coil to the sliver end is linear and its length differs from can to can. In this manner an accurately predetermined total sliver quantity is obtained. In contrast to the known process, the last sliver coil is deposited in each instance at a different location of the coiler can and the linear sliver quantity, that is, the sliver portion from the last sliver coil to the severed end of the sliver is also different from can to can. The linear sliver portion comprises the length portion which hangs over the coiler can edge which is always of the same length and a variable linear sliver length portion inside the coiler can. The total sliver quantity, that is, the annularly deposited sliver and the linear portion is constant for each coiler can. It is a further advantage of the invention that the sliver end is always situated at the same location on the edge of the transverse can wall and its overhung length is always identical. By virtue of the can motion, the continued supply of the sliver by the pressure rolls is enhanced.

The invention has the following additional advantageous features:

- The coiler can is moved outwardly, out of alignment with the coiler head, while a linear sliver length portion is deposited on the sliver coils already disposed in the coiler can.
- When the deposition in an annular pattern is stopped, that is, the coiler head is arrested in its rotation, the sliver advance through the pressure rolls proceeds with a reduced speed.
- The linear length portion of the sliver hangs outwardly over one of the narrow walls of the flat coiler can.
- The coiler head is stopped when its sliver outlet is in alignment with the longitudinal central axis of the coiler can.

The apparatus according to the invention includes a device for determining the position of the sliver outlet of the rotary coiler head on its circular path and a device for determining the running length of the sliver. The apparatus further includes a computer to determine that position of the coiler can which corresponds to a predetermined total deposited sliver quantity less a linear terminal trailing sliver length and further has a device for stopping the rotary motion of the coiler head at the calculated position. The apparatus according to the invention has the following additional advantageous features:

- The device for determining the length position of the coiler can includes a sensor such as an incremental path sensor.
- A drive is provided for effecting a back and forth motion of the coiler can platform underneath the coiler head during the sliver filling operation and the drive has an rpm-regulating device.
- Further, a drive for the coiler head is provided which includes an rpm regulating device.
- A counter or similar device is provided for determining the running sliver quantities.
- A central control device such as a microcomputer including a microprocessor is provided to which the various drives of the apparatus are connected.

BRIEF DESCRIPTION OF THE DRAWINGS

FIG. 4 is a block diagram of a preferred embodiment of the invention associated with a drawing frame handling flat coiler cans.

FIG. 5 is a top plan view of a cylindrical coiler can containing sliver deposited in an annular pattern.

FIG. 6 is a top plan view of a flat coiler can containing sliver deposited in an annular pattern.

DESCRIPTION OF THE PREFERRED EMBODIMENTS

Figure 1:
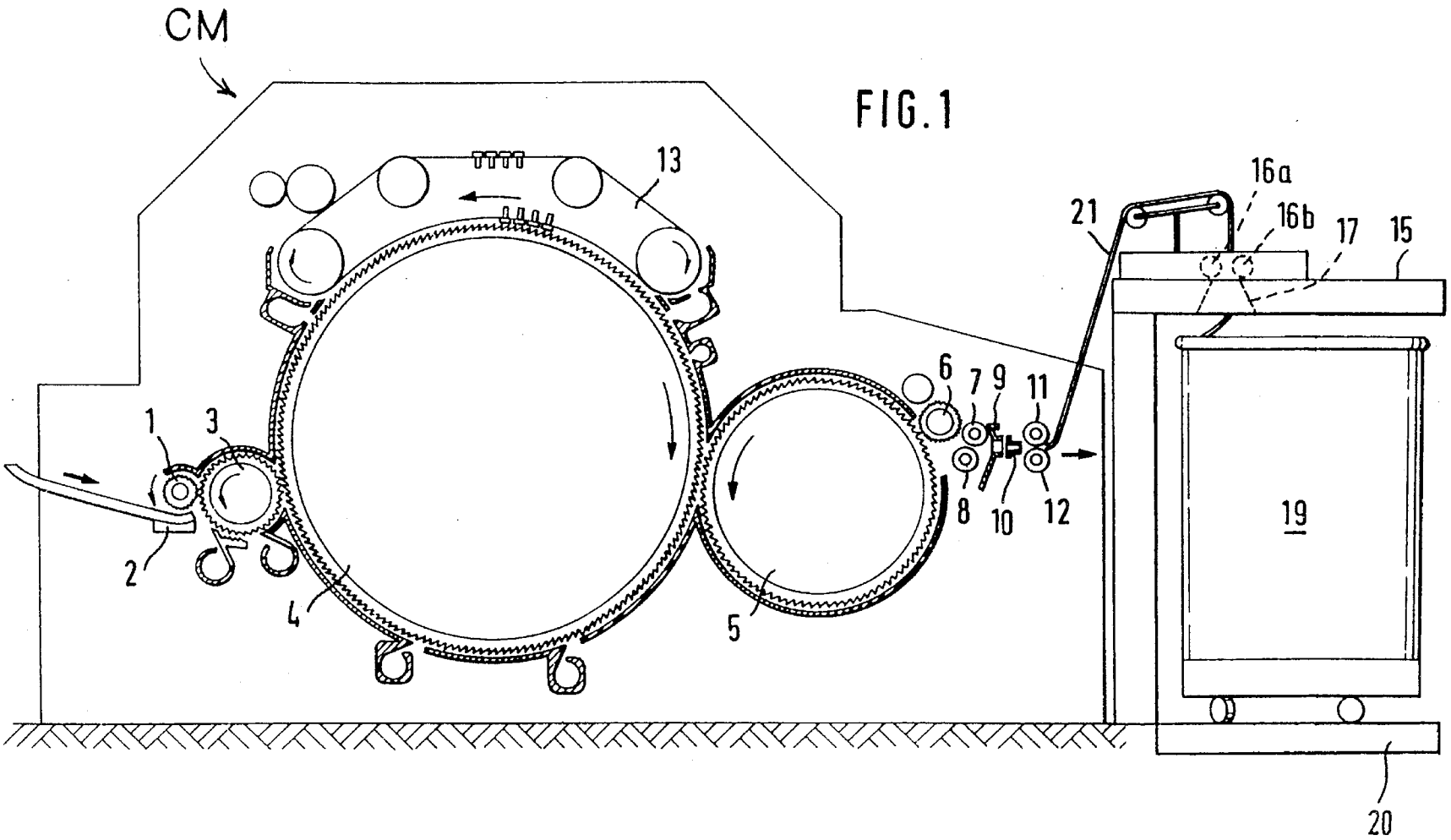
FIG. 1 is a schematic side elevational view of a carding machine incorporating the invention.
Figure 3:
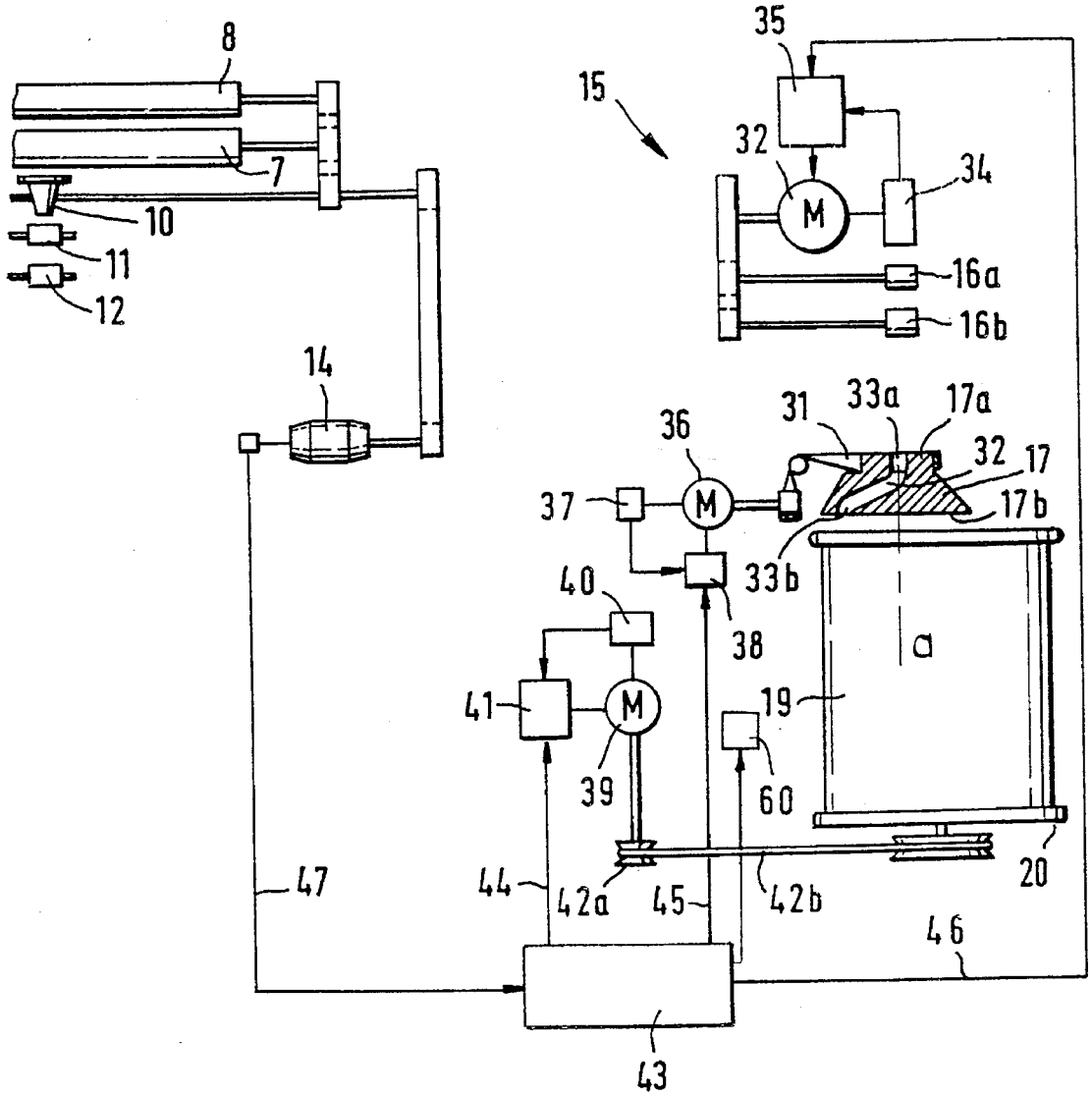
FIG. 3 is a block diagram of a preferred embodiment of the invention associated with a carding machine.

FIG. 1 shows a carding machine CM which may be an EXACTACARD DK 760 model, manufactured by Tr ützschler GmbH & Co. KG, Mönchengladbach, Germany. The carding machine has a feed roll 1, a feed table 2, a licker-in 3, a main carding cylinder 4, a doffer 5, a stripping roll 6, crushing rolls 7 and 8, a web guiding element 9, a sliver trumpet 10, delivery rolls (calender rolls) 11 and 12 as well as traveling flats 13. The delivery rolls 11 and 12, the crushing rolls 7 and 8, the stripping roll 6 and the doffer 5 are driven by a motor 14, as shown in FIG. 3. At the output side of the carding machine CM a sliver coiler 15 is arranged which includes two driven pressure rolls 16*a*, 16*b* and a driven coiler head 17. The cylindrical coiler can 19 is positioned on a driven coiler can platform 20.

Figure 2:
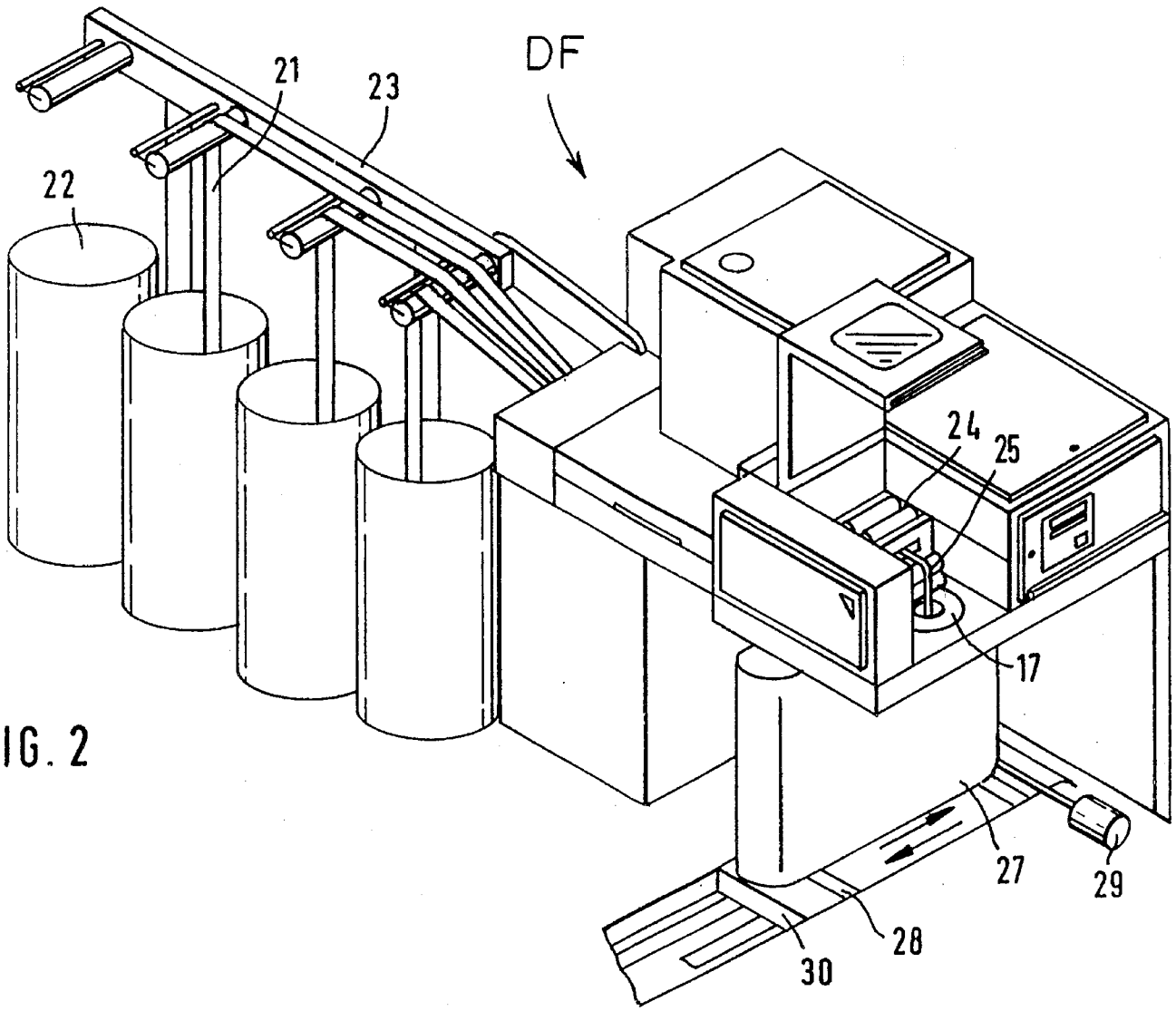
FIG. 2 is a schematic perspective view of a drawing frame incorporating the invention.

FIG. 2 illustrates a drawing frame DF which may be an HS 900 model high-performance drawing frame manufactured by Trützschler GmbH & Co. KG. Underneath the sliver input 23 of the drawing frame DF a plurality of cylindrical (round) coiler cans 22 are arranged and the sliver 21 is drawn from the cans 22 and advanced to the drawing unit 24 of the drawing frame DF. After passing through the drawing unit 24, the drafted sliver 25 is introduced into the coiler head 17 and is deposited thereby in an annular pattern into a flat coiler can 27. The flat coiler can 27 is positioned on a sled 28 which is reciprocated in the direction of the arrows by a shifting device 30 driven by a motor 29.

Turning to FIG. 3, the sliver 21 is advanced to the cooperating pressure rolls (calender rolls) 16*a*, 16*b*. The sliver originates from a sliver-producing spinning preparation machine such as a carding machine CM (FIG. 1) or a drawing frame DF (FIG. 2).

The coiler head 17 is supported for rotation about a vertical axis a and has a belt pulley 17*a* about which a drive belt 31 is trained to provide a driving torque. The coiler head 17 further has a lower plate 17*b* positioned above the coiler can 19 which, in turn, stands on the rotary platform 20. The coiler head 17 has an obliquely oriented sliver channel 33 having an inlet opening 33*a* oriented towards the pressure rolls 16*a*, 16*b* and an outlet opening 33*b* which is situated in the rotary plate 17*b* eccentrically to the vertical axis a of the coiler head 17. The coiler can 19 which may be conventionally provided with a vertically displaceable bottom pressed upwardly by a coil spring, stands on the can platform 20 which is rotatable about a vertical axis coinciding with the axis of the coiler can 19 standing thereon.

The pressure rolls 16*a*, 16*b* are driven by an electric motor 32 which has an rpm transmitter (tachometer) 34 connected to the electric motor 32 by an rpm control device 35. A further electric motor 36 drives the belt 31 to rotate the coiler head 17. The electric motor 36 too, is provided with an rpm transmitter (tachometer) 37 connected to the electric motor 36 by an rpm control device 38. An electric motor 39 drives the coiler can platform 20 by means of a drive pulley 42*a* and a drive belt 42*b*. The electric motor 39 has an rpm transmitter (tachometer) 40 coupled to the electric motor 39 by an rpm control device 41. According to this arrangement all three driving devices have their own rpm regulating circuit respectively formed of the electric motor 32, 36 and 39, the rpm transmitter 34, 37, and 40 as well as the rpm control device 35, 38 and 41.

The desired rpm values 44, 45, and 46 for the drive motors 39, 36 and 32, respectively, are calculated by a central control and regulating device 43 such as a microcomputer. The desired values 44, 45, and 46 are in a predetermined, variable relationship to the delivery speed value 47 of the sliver-producing machine. A conventional sliver severing device 60 is also connected to the control and regulating device to cut the sliver, for example, downstream of the sliver outlet 33*b* of the coiler head 17 when the desired fill level in the coiler can is reached.

When flat coiler cans 27 are used as shown in FIG. 2, they are linearly reciprocated underneath the coiler head 17 by the back-and-forth travelling sled 28.

In FIG. 4 an rpm transmitter 48 and an rpm control device 49 are associated with the drive motor 29 for the reciprocating device 30 of the sled 28 and are connected to the control and regulating device 43. In other respects, the sliver coiler at the outlet end of the drawing frame DF corresponds to the sliver coiler at the output end of the carding machine CM. It should be understood that at the output end of the drawing frame DF the sliver 25 may be deposited in a rotating cylindrical coiler can in which case the can is supported on a rotary platform 20 as shown in FIGS. 1 and 3.

FIGS. 5 and 6 show the annular pattern of the deposited sliver in a cylindrical coiler can 19 (FIG. 5) and in a flat coiler can 27 (FIG. 6).

In the description which follows, the operation of the device according to the invention will be described in connection with a rectangular flat coiler can 27.

Figure 7A:
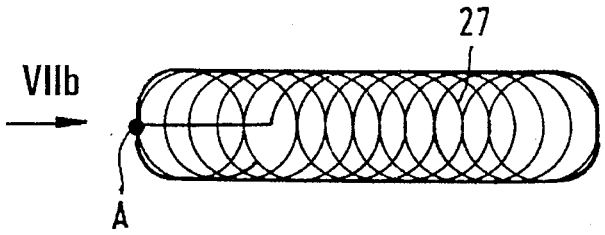
FIG. 7*a* is a top plan view of a flat coiler can filled with sliver deposited therein in an annular pattern and having a linear terminal end portion.
Figure 7B:
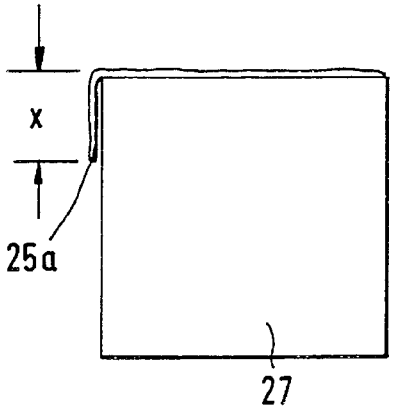
FIG. 7*b* is a schematic side elevational view of the construction shown in FIG. 7*a*, viewed in the direction of the arrow VIIb.
Figure 8:
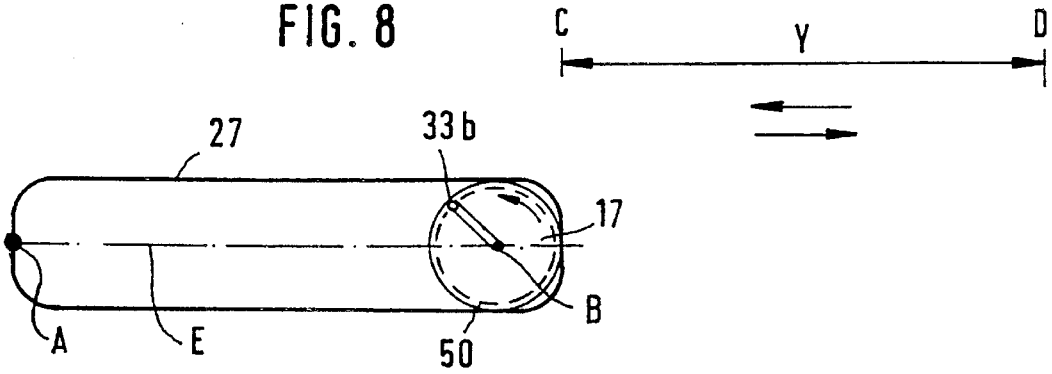
FIG. 8 is a schematic top plan view of a flat coiler can and a coiler head situated above the coiler can.

As shown in FIGS. 7*a* and 7*b*, the sliver end 25*a* should, in a filled coiler can 27, hang over the edge of the can 27 at point A with a length x. Also referring to FIG. 8, during the filling process, the sliver outlet 33*b* of the coiler head 17 rotates along a circular path 50 about a fixed point B. At the same time, the coiler can 27 is linearly moved back and forth between points C and D by a linear distance y which generally corresponds to the horizontal length dimension of the coiler can 27. During this reciprocating motion, the coiler head 17 remains vertically within the outline of the coiler can 27 to receive the sliver therefrom in an annular pattern. This sliver depositing process continues until a predetermined sliver quantity is present in the coiler can 27. Thereafter, the sliver output speed is preferably reduced and the rotary motion of the coiler head 17 is stopped at a predetermined location. Then the coiler can 27 is moved in the direction D until the sliver outlet 33*b* of the coiler head 17 is no longer within the outline of the coiler can 27. This may be achieved, for example, in the FIG. 2 structure by moving the sled 28 further to the left on its linear track. Thereafter, the sliver 25 is severed to produce the sliver end 25*a* and the required overhang x.

The coiler head 17 is stopped when the sliver outlet 33*b* has reached a position on the center axis E of the coiler can 27. The control and regulating device 43 which continuously monitors the momentary position of the coiler can 27 and the sliver outlet 33*b* of the coiler head 17, may exactly calculate as to when the rotary motion of the coiler head 17 should be stopped to fulfill the requirements regarding the sliver quantities (including the overhang x) to be deposited.

A deposition of the sliver 21, 25 into cans 19 or 27 is carried out to provide a means for transporting the sliver to the successive fiber processing machines where the sliver is pulled out of the cans and is introduced into the respective sliver processing machine. Particularly in connection with a fully automated operation where rectangular flat coiler cans 27 are used, the trailing sliver end is deposited in a fully charged coiler can 27 at a predetermined location and in a predetermined form such that in the successive process it may be automatically grasped as the leading end of the sliver. By virtue of the method and apparatus according to the invention, it is feasible to fulfill the additional requirement, that is, that all cans 19 or 27 contain an exactly defined quantity of sliver.

Figure 9:
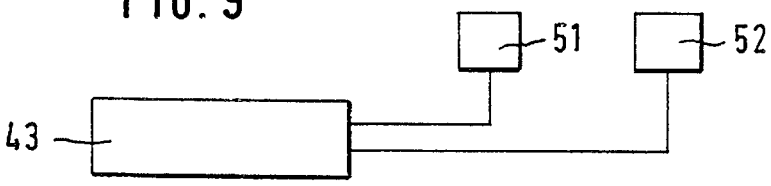
FIG. 9 is a block diagram of a position sensor indicating the longitudinal position of the flat coiler can.

In FIG. 9 a sensor 51, such as an incremental rotary path transmitter or an absolute value transmitter for sensing the length position of the coiler can 27 is connected with the control and regulating device 43. Further, a device 52 is provided to determine the running length of the sliver 25 and is connected to the control and regulating device 43.

It will be understood that the above description of the present invention is susceptible to various modifications, changes and adaptations, and the same are intended to be comprehended within the meaning and range of equivalents of the appended claims.

What is claimed is:

1. A method of depositing sliver into a coiler can, comprising the following steps:

(a) rotating a pair of cooperating pressure rolls;

(b) advancing the sliver by the pressure rolls to a coiler head having a sliver outlet;

(c) rotating said coiler head for causing said sliver outlet to travel in a circular path;

(d) positioning an upwardly open coiler can underneath the coiler head;

(e) moving said coiler can for continuously changing the position thereof relative to said coiler head;

(f) depositing sliver through said sliver outlet of said coiler head into said coiler can during performance of steps (b), (c) and (e), whereby the coiler can is charged with sliver in an annular pattern;

(g) discontinuing step (c) while continuing step (b) when a predetermined total sliver quantity less a terminal linear trailing sliver length portion is contained in the coiler can;

(h) after step (g), linearly moving said coiler can beyond the non-rotating coiler head for depositing a linear sliver length portion in the coiler can; and (i) severing the sliver at a predetermined location to obtain a trailing sliver end portion hanging outward and downward across an upper wall edge of the coiler can.

2. The method as defined in claim 1, further comprising the step of reducing the delivery rate of sliver advanced by the pressure rolls upon performance of step (g).

3. The method as defined in claim 1, wherein said coiler can has an elongated rectangular horizontal cross-sectional outline and wherein step (h) comprises the step of moving the coiler can parallel to the horizontal length dimension thereof for causing the sliver end portion to hang across an upper wall edge of a narrow side of the coiler can.

4. The method as defined in claim 3, wherein the coiler can has a horizontal longitudinal center line; and further wherein step (g) includes the step of stopping rotation of said coiler head when said sliver outlet of said coiler head is in alignment with said horizontal longitudinal center line.

5. An apparatus for depositing sliver in a coiler can having an elongated horizontal outline, comprising (a) a pair of cooperating rolls;

(b) first drive means for rotating said rolls to cause a sliver to be advanced by said rolls;

(c) a coiler head supported for rotation about a rotary axis; said coiler head having a sliver inlet for receiving sliver from said rolls and a sliver outlet situated eccentrically with respect to said rotary axis for discharging sliver from said coiler head;

(d) second drive means for rotating said coiler head about said rotary axis for causing said sliver outlet to travel on a circular path;

(e) a linearly movable coiler can support disposed underneath said coiler head for receiving an upwardly open coiler can thereon;

(f) third drive means for moving said coiler can support relative to said coiler head in a reciprocating path for causing the sliver to be deposited by said coiler head in said coiler can in an annular pattern along a can length;

(g) first ascertaining means for determining a position of said sliver outlet on said circular path;

(h) second ascertaining means for determining a position of said coiler can support on said reciprocating path;

(i) third ascertaining means for determining a running length of the sliver during deposition thereof into the coiler can;

(j) severing means for severing the sliver at a location downstream of said rolls as viewed in a direction of sliver run; and (k) a control and regulating device; said first, second and third driving means and said first, second and third ascertaining means and said severing means being connected to said control and regulating device; said control and regulating device including means for stopping rotation of said coiler head when said sliver outlet is in a position corresponding to a predetermined total sliver quantity in the coiler can less a trailing terminal sliver length portion, for linearly moving said coiler can support in a stopped state of said coiler head such that the coiler can outline is out of vertical alignment with said coiler head, whereby the trailing length portion is deposited in the coiler can and a part of the trailing length portion hangs over a top wall edge of the coiler can and for actuating said severing means to obtain a terminal length portion having a sliver end hanging over a top wall edge of the coiler can.

6. The apparatus as defined in claim 5, wherein said first ascertaining means includes a sensor.

7. The apparatus as defined in claim 5, wherein said second drive means includes an rpm regulator.

8. The apparatus as defined in claim 5, wherein said third drive means includes an rpm regulator.

9. An apparatus for depositing sliver in a coiler can having a circular outline, comprising (a) a pair of cooperating rolls;

(b) first drive means for rotating said rolls to cause a sliver to be advanced by said rolls;

(c) a coiler head supported for rotation about a rotary axis; said coiler head having a sliver inlet for receiving sliver from said rolls and a sliver outlet situated eccentrically with respect to said rotary axis for discharging sliver from said coiler head;

(d) second drive means for rotating said coiler head about said rotary axis for causing said sliver outlet to travel on a circular path;

(e) a rotatable coiler can support disposed underneath said coiler head for receiving an upwardly open coiler can thereon;

(f) third drive means for rotating said coiler can support relative to said coiler head in a circular path for causing the sliver to be deposited by said coiler head in said coiler can in an annular pattern;

(g) first ascertaining means for determining a position of said sliver outlet on said circular path;

(h) second ascertaining means for determining an angular position of said coiler can support;

(i) third ascertaining means for determining a running length of the sliver during deposition thereof into the coiler can;

(j) severing means for severing the sliver at a location downstream of said rolls as viewed in a direction of sliver run; and (k) a control and regulating device; said first, second and third drive means and said first, second and third ascertaining means and said severing means being connected to said control and regulating device; said control and regulating device including means for stopping rotation of said coiler head when said sliver outlet is in a position corresponding to a predetermined total sliver quantity in the coiler can less a trailing terminal sliver length portion.

* * * * *